US006070353A

United States Patent [19]

Albrecht et al.

[11] Patent Number: 6,070,353

[45] Date of Patent: Jun. 6, 2000

[54] HAMMER FOR A PORTABLE FIREARM

[75] Inventors: Hermann Albrecht, Oberndorf; Hans Peter Bantle, Dunnigen; Robert Knöpfle, Alpirsbach; Helmut Weldle, Oberndorf, all of Germany

[73] Assignee: Heckler & Koch GmbH, Oberndord, Germany

[21] Appl. No.: 08/945,359

[22] PCT Filed: Mar. 20, 1996

[86] PCT No.: PCT/EP96/01207

§ 371 Date: Oct. 9, 1997

§ 102(e) Date: Oct. 9, 1997

[87] PCT Pub. No.: WO96/32619

PCT Pub. Date: Oct. 17, 1996

[30] Foreign Application Priority Data

Apr. 13, 1995 [DE] Germany ..... 296 06 416 U

[51] Int. Cl.[7] ..... F41A 17/74; F41A 19/14

[52] U.S. Cl. ..... 42/69.01

[58] Field of Search ..... 42/69.01, 69.02, 42/69.03, 65, 66

[56] References Cited

U.S. PATENT DOCUMENTS

| | | | |
|---|---|---|---|
| 3,713,241 | 1/1973 | Dieckmann | 42/69.03 |
| 4,122,622 | 10/1978 | Angelino | 42/65 |
| 4,694,602 | 9/1987 | Pust | 42/59 |
| 5,335,437 | 8/1994 | Andersen | 42/70.08 |

*Primary Examiner*—Charles T. Jordan
*Assistant Examiner*—Denise J. Buckley
*Attorney, Agent, or Firm*—Louis Weinstein

[57] ABSTRACT

A hammer for a portable firearm, such as automatic pistol, which hammer is at least partially exposed and has a hammer piece (1), arranged for firing a bullet cartridge by striking action and an end piece (2) extending a given distance for facilitating grasping of the hammer piece and preferably connected to the hammer piece (1) in a flexible manner, where either the end piece (2), extends a given distance on the hammer piece (1), is mounted via a flexible connection, or the end piece (2) is made of a flexible material.

7 Claims, 1 Drawing Sheet

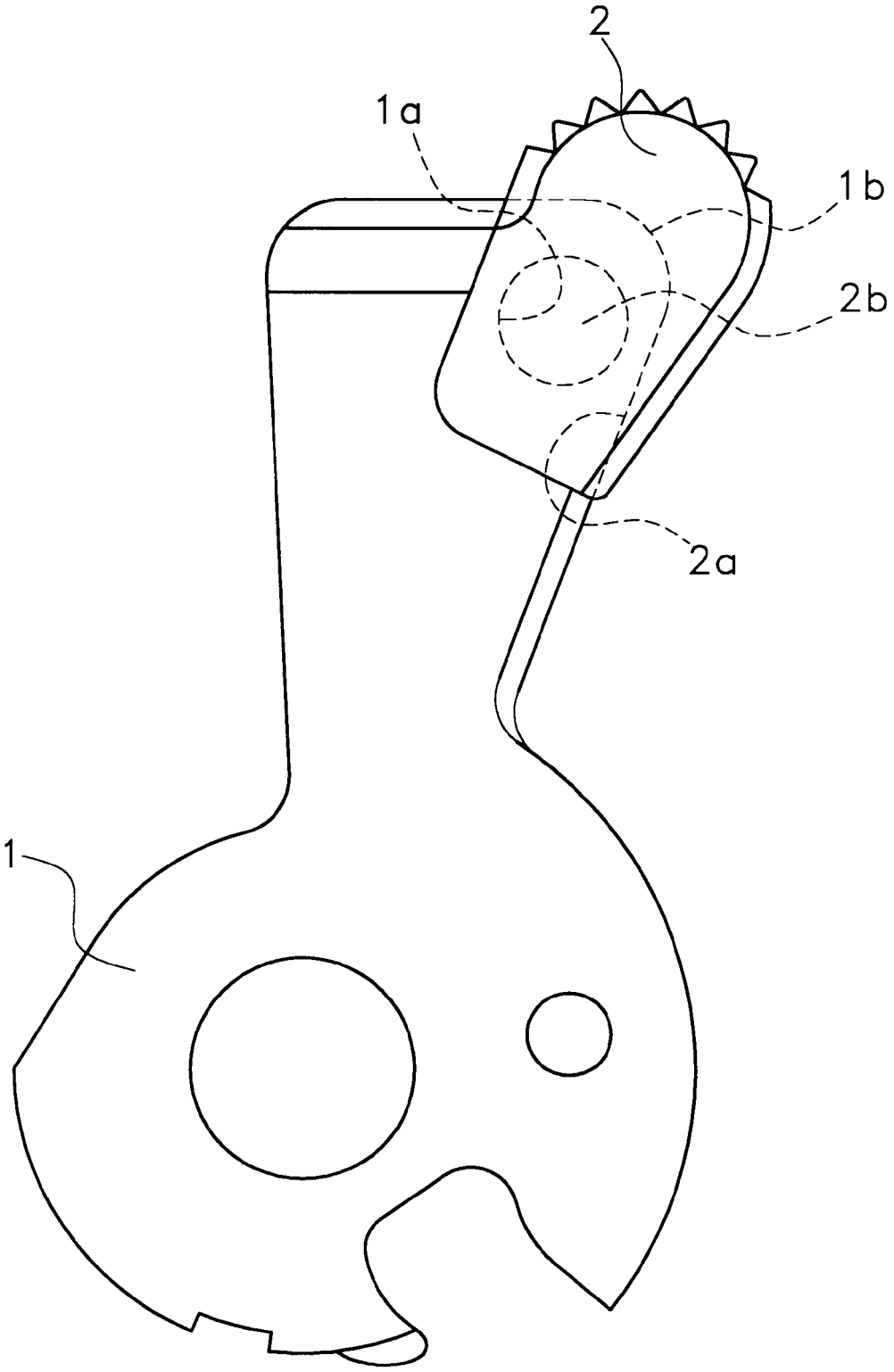
2
1a
1b
2b
2a
1

HAMMER FOR A PORTABLE FIREARM

FIELD OF THE INVENTION

The invention involves a portable firearm, preferably a small firearm, and even more preferably, an automatic pistol, having a hammer which is at least partially exposed and having a hammer piece for firing a bullet cartridge by striking action. An end of the hammer piece extends rearwardly a given distance which is provided to facilitate grasping the hammer piece and is preferably connected to the hammer piece in a flexible manner.

BACKGROUND OF THE INVENTION

For weapons of the type of the present invention, the hammer is arranged in order to strike a striking pin, which in turn strikes a bullet cartridge to fire the cartridge.

The striking pin (not shown) sits in a recess of the breech of the weapon (not shown). A weak spring (not shown) urges the striking pin to extend out a bit in the rearward direction from this recess. A rear edge of the recess limits the striking movement of the hammer, after the hammer has first struck the rear end of the striking pin, and has moved it forward.

For safety reasons, the striking pin is shorter than the distance between the bottom of the bullet cartridge and the rear edge of the aforementioned recess so that it moves over a fixed distance in free-flight after it has been hit by the hammer.

In some weapons of the type described, the hammer is capable of sitting in the recess while it is uncocked and when the trigger is not actuated, such that it urges the striking pin forward slightly. If the hammer strikes against an object, for example, when the firearm accidentally falls to the ground, the blow will be guided via the hammer into the edge of the recess.

However, it has been observed that the igniting apparatus of the bullet cartridge causes a slight impression after an occurrence of this type. This is a safety risk.

OBJECT OF THE INVENTION

An object of the present invention is to eliminate this safety risk by providing a hammer with a flexible gripping member or a flexible connector capable of damping an impact to the gripping member to prevent accidental firing of the firearm.

The above as well as other objects of the present invention are achieved according to the present invention by providing a hammer piece for a portable firearm having an end extending a given distance for grasping the hammer piece, which is either arranged on the hammer piece via a flexible connection or consists of flexible material.

Preferred embodiments of this solution are set forth below.

According to the invention, the part of the hammer which is located outside of the weapon and being in a position such that it can receive an undesired blow, is connected elastically, or better yet, elastically and with a damping effect, to the hammer piece, and is preferably obtained from a flexible, damping material such as rubber. The duration of the blow which is transmitted by the hammer is prolonged in the process and the mechanical pulse is thereby reduced. Moreover, damping material consumes pulse energy.

Two documents deal with the set of problems described above (DE-GM 69 22 046and CH-PS 131 130, both of which are incorporated herein by reference thereto). In DE-GM 69 22 046, no force-transmitting connection of any sort is present between the hammer piece and the end portion which extends a given distance, while CH-PA 131 130 shows a complicated actuation element set into the hammer, which should hold the hammer fixed in its uncocked position.

Vulcanizing the grip onto a connection surface of the hammer piece, where the mount requires roughness and undercuts, is especially long-lasting.

BRIEF DESCRIPTION OF THE FIGURE

The sole FIGURE is a plan view of a hammer embodying the principles of the present invention. The object of the invention shown in the sole FIGURE, is shown greatly enlarged.

DETAILED DESCRIPTION OF THE INVENTION

The hammer shown comprises a hammer piece 1, which is connected to a grip 2 on its outermost end, which is exposed when the hammer is installed and is the part of the hammer that is struck by an object if the weapon falls or is dropped.

The grip 2 has a receiving slot 2*a* and is made out of viscoplastic rubber and is vulcanized onto the hammer piece 1, which is made of steel.

The grip 2 is pulled down over opposite sides of the hammer piece in order to absorb a side impact, and an integral projection 2*b* of grip 2 extends into hole la drilled in the hammer piece 1 in order to obtain a better hold. The contour l*b* of the hammer piece 1 is shown by dashed lines where it is covered by the grip 2.

We claim:

1. A hammer for a firearm, comprising:

a hammer piece (1), for firing a bullet cartridge by striking action and an end piece (2), which is set off at a distance from a firing portion, being arranged for grasping the hammer piece (1) and is connected thereto, characterized in that the end piece (2), being mounted to the hammer piece by a non-rigid, flexible connection, and the end piece (2), is set off at a given distance, is made of a flexible material, and is utilized.

2. A hammer according to claim 1, characterized in that the flexible material of the end piece (2) set off at a distance, and the flexible connection, provides damping to prevent accidental firing.

3. A hammer for a firearm, comprising:

a hammer piece (1), for firing a bullet cartridge by striking action and an end piece (2), which is set off at a distance from a firing portion, being arranged for grasping the hammer piece (1) and is connected thereto, characterized in that the end piece (2), which is set off at a given distance, is made of a flexible material, is utilized, said end piece (2) being formed of rubber.

4. A hammer according to claim 3, characterized in that the rubber end piece (2) set off at a distance is vulcanized onto the hammer piece (1).

5. A hammer according to claim 3, characterized in that the hammer piece (1) has a recess which goes partially into its depth dimension, into which the rubber end (2) engages in a form-fit manner.

6. A hammer according to claim 4, characterized in that the hammer piece (1) has a recess which goes partially into its depth dimension, into which the rubber end (2) engages in a form-fit manner.

7. A hammer according to claim 5, characterized in that the recess is a crosswise drill hole extending through the hammer.

* * * * *

UNITED STATES PATENT AND TRADEMARK OFFICE

CERTIFICATE OF CORRECTION

PATENT NO : 6,070,353

DATED : June 6, 2000

INVENTOR(S) : Albrecht et al.

It is certified that error appears in the above-identified patent and that said Letters Patent are hereby corrected as shown below:

IN THE CLAIMS

In claim 7, at column 2, line 52, before the first occurrence of the word "the", insert therefor --one of arrangements of--.

At column 2, line 5, delete "DE-GM 69 22 046and" and insert therefor --DE-GM 69 22 046 and--.

Signed and Sealed this

Eighth Day of May, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 6,070,353
DATED : June 6, 2000
INVENTOR(S) : Albrecht et al.

It is certified that error appears in the above-identified patent and that said Letters Patent is hereby corrected as shown below:

Claim 1, column 2,
Line 52, before the first occurrence of the word "the", insert therefor -- one of arrangements of --.

Column 2,
Line 4, delete "DE-GM 69 22 046and" and insert therefor -- DE-GM 69 22 046 and --.

This Certificate supercedes Certificate of Correction issued May 8, 2001.

Signed and Sealed this

Second Day of October, 2001

*Attest:*

Nicholas P. Godici

NICHOLAS P. GODICI
*Acting Director of the United States Patent and Trademark Office*

*Attesting Officer*